United States Patent [19]

Frost

[11] Patent Number: 4,768,743

[45] Date of Patent: Sep. 6, 1988

[54] CONTAINER HOLDER

[76] Inventor: Richard A. Frost, P.O. Box 2462, Durban, Natal, 4000, South Africa

[21] Appl. No.: 89,013

[22] Filed: Aug. 21, 1987

[30] Foreign Application Priority Data

Aug. 26, 1986 [ZA] South Africa ..... 86/6453

[51] Int. Cl.[4] ..... B65D 35/56

[52] U.S. Cl. ..... 248/108; 248/312

[58] Field of Search ..... 248/108, 109, 312, 312.1, 248/318; 211/84, 71, 88, 74, 76; 215/347, 348; 222/180

[56] References Cited

U.S. PATENT DOCUMENTS

| | | | |
|---|---|---|---|
| 1,570,396 | 1/1926 | Pollock | 248/109 X |
| 2,188,227 | 1/1940 | Moore | 248/312 UX |
| 2,600,553 | 6/1952 | Lord | 248/108 UX |
| 2,680,038 | 6/1954 | Gray | 248/312 UX |
| 3,062,490 | 11/1962 | Morgan | 248/312 X |
| 3,365,761 | 1/1968 | Kalvig | 248/314 X |
| 4,089,434 | 5/1978 | Tagalakis | 215/347 X |

FOREIGN PATENT DOCUMENTS

| | | | |
|---|---|---|---|
| 404099 | 6/1966 | Switzerland | 248/108 |

*Primary Examiner*—J. Franklin Foss

*Attorney, Agent, or Firm*—Young & Thompson

[57] ABSTRACT

A paste tube holder (10) comprises an L shaped bracket (14) having a cylindrical housing (16) which is closed by resilient inwardly directed fingers (28). A pad (25) and a foamed polymeric block (24) fill the housing (16). In use the pad and block (25,26) bias the fingers (28) to the closed position. On insertion of the nozzle of a tube the fingers (28) yield allowing location and gripping of the nozzle in position.

3 Claims, 1 Drawing Sheet

CONTAINER HOLDER

FIELD OF THE INVENTION

This invention relates to a holder for toothpaste tubes, or other containers such as for soaps, shampoos and the like for domestic, industrial and club use.

BACKGROUND

Many arrangements have been proposed for holding toothpaste tubes and other containers, particularly in a vertical position and more particularly in a capless condition. As far as the Applicant is aware none of the prior art arrangements has been a commercial success and it is an object of the present invention to provide a simple and effective holder which holds the container in an easily accessible location and which also seals the opening.

THE INVENTION

According to the invention a container holder includes a bracket having a cylindrical member having a series of inwardly-directed formations which are flexible enough to permit passage therethrough of the neck of a container under normal hand pushing or pulling pressure and rigid enough to prevent the neck falling out by gravity, a disc of impermeable material behind the formations and a deformable mass behind the disc for biassing it against the opening of the container.

Preferably the container comprises a bottle having a neck which is screw threaded to receive a cap, a paste tube or the like.

In the preferred form of the invention the formations take the form of a series of inwardly directed fingers defining an opening therebetween.

According to a further aspect of the invention, the disc comprises a pad of resilient material. In one form of the invention the pad is backed by a second pad of foamed polymeric material which fills the space in the cylindrical member, or the resilience of the pad providing the necessary bias.

The first pad may be of unexpanded polymeric material and therefore acts to seal the opening of the neck which is important from a hygienic point of view. A sheet of impermeable material may be located above the first pad for complete sealing—for example a disc of polymeric material.

According to a further aspect of the invention, the bracket or the like includes orifices or formations for supporting one or more toothbrushes.

EMBODIMENT OF THE INVENTION

Embodiments of the invention are now described with reference to the attached drawings where:

Figure 1:
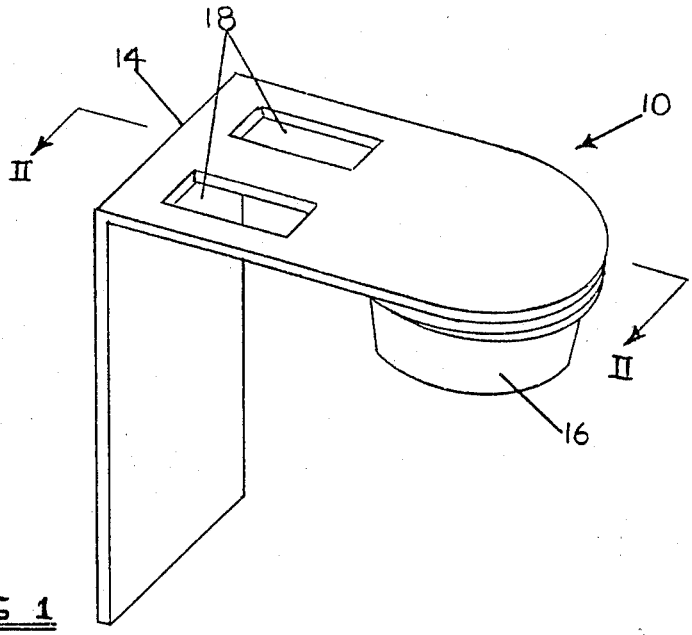
FIG. 1 shows a three-dimensional view of one embodiment of the invention.
Figure 2:
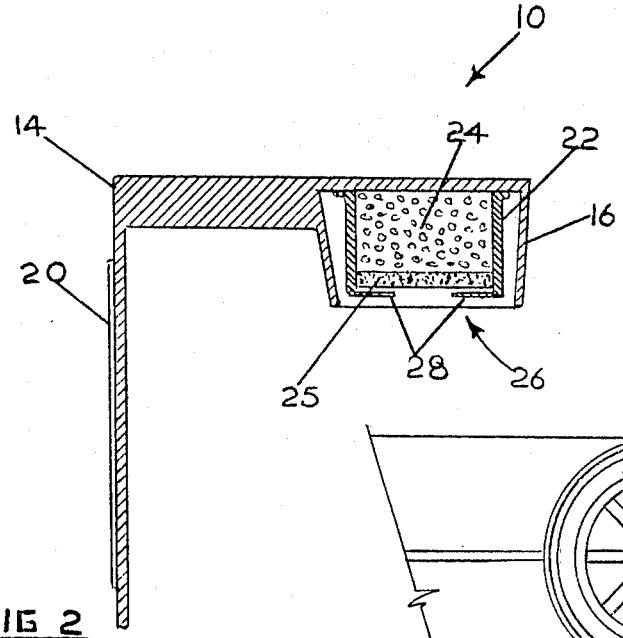
FIG. 2 shows a sectional elevation on section II—II of FIG. 1.
Figure 3:
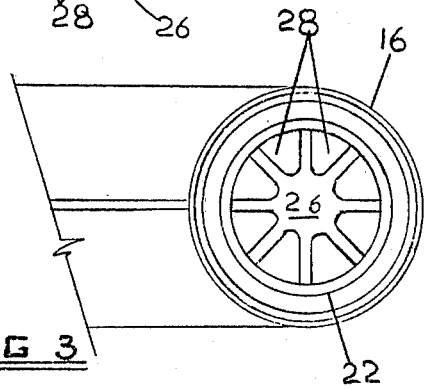
FIG. 3 shows a partial under-plan view.

Reference to the drawings shows a tube holder 10 comprising an "L"-shaped bracket 14 which includes a cylindrical portion 16 and also contains two toothbrush appertures 18 in the horizontal section, and wall adhesive material 20 on the vertical section.

Within the cylindrical portion 16 a separate cylindrical member 22 is attached into which a resilient pad 24 is inserted prior to assembly. The pad 24 has a sealing disc 25 which is attached to one of its ends. This pad is designed to both seal the tube (not shown) and to provide a firm downward pressure on the tube. The mouth 26 of the cylindrical member includes a series of inwardly facing fingers 28 which define an opening approximately equal to the diameter measured across the base of the thread of the tube nozzle. The fingers 28 are made from a flexible material designed to allow the repeated forced insertion and extraction of the tube nozzle.

The resilient pad 24 may be of an expanded polymeric or sponge-type material and may have a surface of unexpanded polymeric (not shown) or similar material which would provide a better seal and also prevent toothpaste or the like entering the pores of the sponge-type pad. The resilient pad may be substituted with other spring means to provide the required degree of resiliency for sealing the disc to the nozzle. As an alternative or in addition a separate disc of impermeable material may be inserted between the disc 25 and the pad 24.

Although this embodiment has been directed to a toothpaste holder, it will be appreciated that it may be adapted for other containers such as for soap, hair lotions, perfumery, shampoos and the like.

I claim:

1. A container holder including mounting means and a cylindrical member having a series of inwardly directed resilient finger-like projections defining a circular opening at the free ends thereof which are flexible enough to permit passing therethrough of a neck of the container under normal hand pushing or pulling pressure and rigid enough to prevent the container from falling out by gravity, a disc of material impermeable to the contents of the container behind the formations and a deformable mass behind the disc for biasing the disc against the neck of the container.

2. A container holder according to claim 1 in which the cylinder member rearwardly of the pad is filled with a foamed polymeric material providing the bias.

3. A container holder according to claim 1 in which the disc is of an unexpanded polymeric material and acts as a seal for the opening of the neck.

* * * * *